United States Patent [19]

Sacca

[11] Patent Number: 4,470,455

[45] Date of Patent: Sep. 11, 1984

[54] PLATE TYPE HEAT EXCHANGER TUBE PASS

[75] Inventor: Demetrio B. Sacca, Lockport, N.Y.

[73] Assignee: General Motors Corporation, Detroit, Mich.

[21] Appl. No.: 338,248

[22] Filed: Jan. 11, 1982

Related U.S. Application Data

[63] Continuation-in-part of Ser. No. 53,684, Jul. 2, 1979, abandoned, which is a continuation-in-part of Ser. No. 916,826, Jun. 19, 1978, abandoned.

[51] Int. Cl.[3] ..... F28F 3/08

[52] U.S. Cl. ..... 165/167; 165/166; 165/153

[58] Field of Search ..... 165/153, 166, 167, 170

[56] References Cited

U.S. PATENT DOCUMENTS

| | | | |
|---|---|---|---|
| 1,775,041 | 9/1930 | Karmazin | 165/151 |
| 2,551,084 | 6/1950 | Shaw | 165/157 X |
| 2,777,674 | 1/1957 | Wakeman | 165/167 |
| 2,858,112 | 10/1958 | Gestung | 165/153 |
| 3,255,816 | 6/1966 | Rosenblad | 165/166 |
| 3,532,161 | 10/1970 | Lockel | 165/167 |
| 4,002,201 | 1/1977 | Donaldson | 165/166X |
| 4,249,597 | 2/1981 | Carey | 165/166 |

FOREIGN PATENT DOCUMENTS

| | | | |
|---|---|---|---|
| 457000 | 11/1936 | United Kingdom | 257/130 C |
| 660469 | 11/1951 | United Kingdom | 165/167 |

*Primary Examiner*—Stephen F. Husar

*Attorney, Agent, or Firm*—R. L. Phillip

[57] ABSTRACT

A fluid tube pass for a heat exchanger formed by a pair of plate members which have their edge portions joined together to form a refrigerant enclosure between plate midportions for flow. Fluid inlet and outlet manifolds are formed at either plate end by drawn, outwardly offset configurations. Between the manifolds, rows of separated ribs are similarly formed, each rib angled obliquely to the flow path between the manifolds and each row extending transversely normal to the flow path. The ribs in each row are staggered and overlap other ribs in the direction of flow to prevent linear flow across all the transverse rows between the inlet manifold and the outlet manifold but provide an interrupted linear flow path or by-pass across the middle of the transverse rows in addition to by-pass flow paths past the ends of the rows to improve heat transfer efficiency without substantially increasing pressure drop.

2 Claims, 9 Drawing Figures

PLATE TYPE HEAT EXCHANGER TUBE PASS

This application is a continuation-in-part of my copending Application Ser. No. 053,684 filed July 2, 1979 which is a continuation-in-part of my parent application Ser. No. 916,826 filed June 19, 1978, both abandoned.

This invention relates to plate type heat exchanger tube passes and more particularly to such a pass formed by plate members with a staggered rib arrangement.

Prior fluid tube passes for a heat exchanger, such as an evaporator, have been formed by plate members with their edge surfaces joined to form a flow passage therebetween. The plate midportions between the inlet and outlet are configured with ribs formed in rows across the tube pass. Previously, the ribs in each row were aligned so as to form linear flow paths across the rows between the inlet and the outlet. According to the present invention there is provided a tube pass which prevents linear flow of fluid such as refrigerant across all the rows between the inlet and outlet in a maner providing significantly improved heat transfer without significantly increasing the resistance to flow. Therefore, the heat exchange effectiveness of similarly dimensioned tube passes has been increased. This permits the use of a thinner, lighter and less costly plate type heat exchanger. With the present emphasis on weight reduction and compactness in the new smaller sized automobiles, the features of the subject tube pass are particularly important as for example, when they are employed in the construction of the evaporator in an air conditioning system therefor.

The present tube pass provides a very efficient heat transfer design by the use of a plurality of transversely extending rows of separated ribs having a staggered and overlapping rib configuration. In the most preferred construction the staggered and overlapping rib configuration provides a particularly tortuous flow path for fluid but with many avenues of flow including bypass flow around the transverse rib rows and also interrupted linear flow thereacross which substantially diminish the pressure drop across the length of the tube pass. Moreover, this arrangement provides excellent fluid distribution across the width of the tube pass and within the tube for efficient use of the extensive heat transfer area thus provided.

Further advantages, features and objects of the present invention will become more apparent from the following description and drawings in which.

Figure 1:
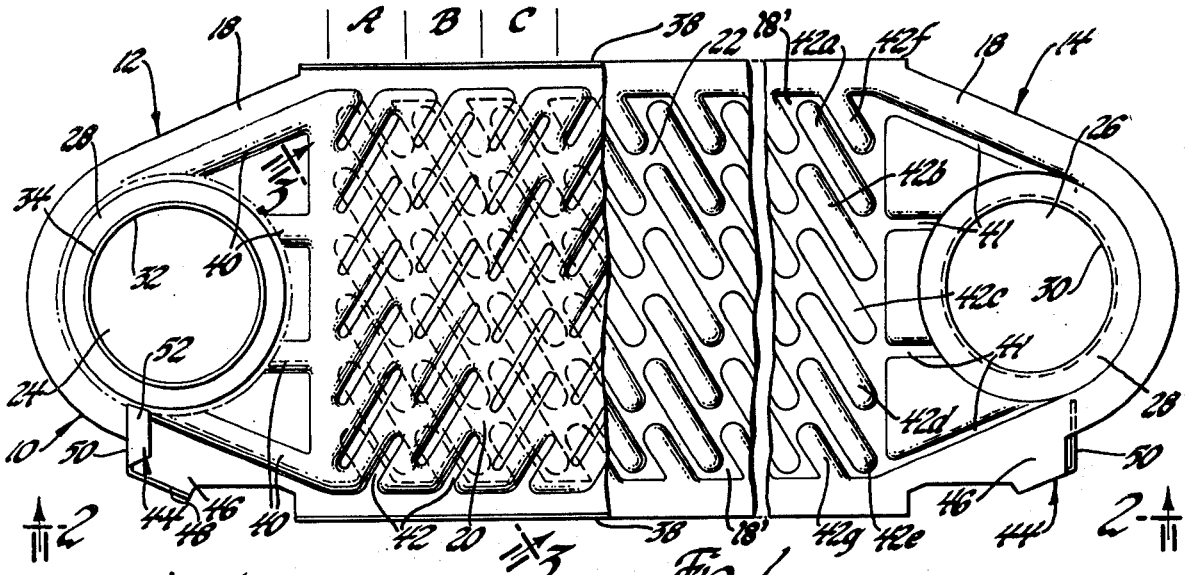
FIG. 1 is a planar view of an evaporator with a tube pass which is progressively broken away from left to right to show exterior portions of the top plate, and interior portions of the bottom plate with these plates configured according to one embodiment of the invention.
Figure 2:
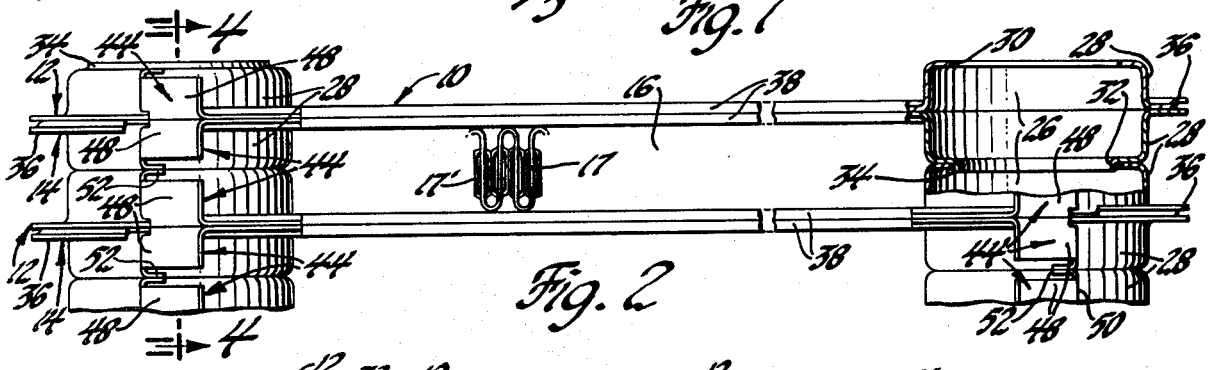
FIG. 2 is an elevational view of several stacked tube passes forming a portion of the evaporator core and looking in the direction of arrows 2—2 in FIG. 1.

In FIGS. 1-5 of the drawings, tube passes 10 are illustrated each of which consists of plate members 12 and 14 configured according to one embodiment of the invention and which when stacked as shown in FIG. 2 form a heat exchanger core adapted to be used as an evaporator. In FIG. 2, two tube passes are illustrated and part of a third. The tube passes 10 are stacked as shown in FIG. 2 to define a space 16 therebetween for the flow of air therebetween. The space 16 normally includes a corrugated metal center structure 17 with fins 17' struck out therefrom for increasing the heat exchange efficiency. For clarity, only a portion of center structure 17 is illustrated.

Figure 5:
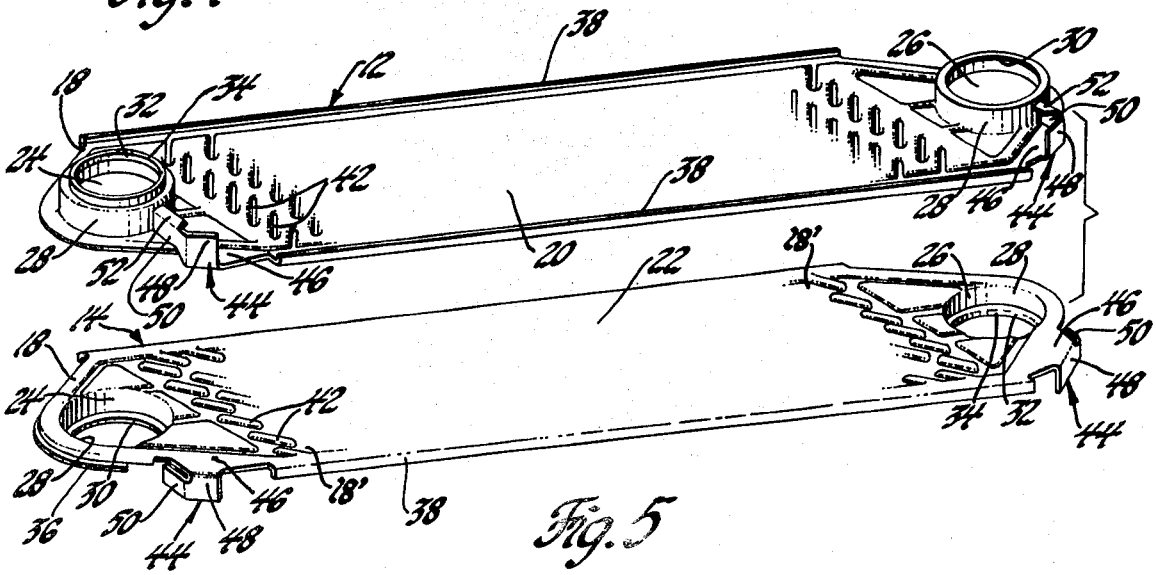
FIG. 5 is a perspective view of the tube pass plates and spaced to reveal the interior configurations.

In FIG. 1, the plates 12 and 14 are shown in normal overlying relationship. The leftward portion of the drawing showing the top, exterior surface of the upper plate 12 while the rightward portion shows the interior surface of plate 14. As best seen in FIG. 5, the plates 12 and 14 are adapted to engage one another in stacked relation when positions for assembly.

The individual plates 12 and 14 are configured identically and for stacking to form a tube pass, one of the plates is simply inverted and rotated 180°. Each plate has a flat peripheral edge portion 18 and the portions 18 of the two plates are formed so as to engage one another prior to subsequent braze jointure. The midportions 20, 22 of plates 12 and 14 are offset upward and downward, respectively, from the edge portions 18. Thus, when the edges 18 engage, the general planes of midportions 20, 22 are spaced from one another.

a fluid such as refrigerant in the evaporator usage, is introduced into the tube pass at one end and is discharged at the other end. Inlet and outlet manifolds 24, 26 of tube pass 10 are formed by outwardly offset and generally circular portions 28 in plates 12 and 14. Each plate 12, 14 has one offset portion 28 formed at one end. An opening 30 is provided in the top surface at one end and an opening 32 is provided with an outwardly raised flange portion 34 at the other end. Thus, the plates are designed so that the flange portion 34 surrounding opening 32 fittingly engages the opening 30. This provides a registering relationship between the plates of two different tube passes, as is evident from FIG. 2. Subsequently, the tube passes are brazed together to form the heat exchanger core partially shown in FIG. 2 which is adapted to be used as an evaporator in an air conditioning or refrigeration system.

At one end of a plate near opening 30 and slightly outward from the flat edge portion 18, an upwardly turned edge portion 36 is formed. Similarly along the extended side edges 38, the edge portion outward from portion 18 is turned normally upward from the flat edge surface 18. This helps stiffen the plate.

Figure 4:
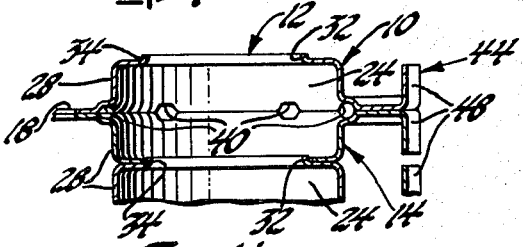
FIG. 4 is a sectioned view of the evaporator taken along section line 4—4 in FIG. 2 and looking in the direction of the arrows.
Figure 3:
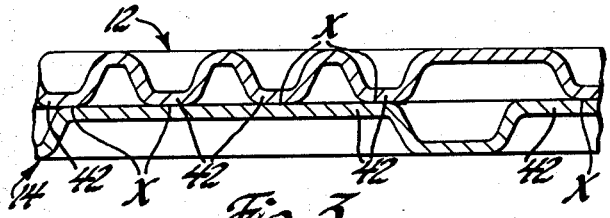
FIG. 3 is an enlarged fragmentary sectioned view taken along section line 3—3 in FIG. 1 and looking in the direction of the arrows.

To provide even distribution of fluid across the tube pass, four flow channels 40 are formed as best shown in FIGS. 1 and 4. The flow channels 40 permit fluid to pass from the inlet manifolds 24 into the intermediate flow portion formed between the intermediate surface portions 20, 22 of plates 12 and 14. Likewise, similar channels 41 at the rightward end of the tube pass in FIG. 1 permit fluid to flow into the outlet manifold 26.

Fluid flow through the intermediate portions of the tube pass between raised surfaces 20, 22 is directed by a specific non-planar configuration of the intermediate surfaces 20, 22. The surface areas 20, 22 are generally offset from the plane of the edge 18 in the same direction as the manifolds 28 but they are not strictly planar and include a particular ribbed formation including a plurality of relatively short-length and spaced ribs 42 which project downward from the surface areas 20 and 22 in the opposite direction as the manifold portions 28. The ribs 42 are relatively short-length depressions in the intermediate portion with a length in the illustrated embodiment of approximately one-third of the tube pass width. The ribs are aligned in rows in the tube pass extending transversely substantially the width of the plate member and are labeled A, B and C in FIG. 1. The fully illustrated evaporator has about 19 such transverse rows. The ribbed depressions or channels 42 in each row are inclined with respect to the direct flow line between the manifolds 24, 26 as seen in FIG. 1. Also evident from both FIGS. 1 and 5 is the opposite orientation of channels 42 in the two plates of a single tube pass. This opposed angular orientation of the ribbed channels 42 occurs as a result of the inversion of one plate during assembly. As the reader may recall, one plate is turned over or inverted and rotates 180° C. with respect to the second plate before assembling. Thus, the orientation of the ribbed channels 42 is reversed. As a result of this inversion, the ribs of one plate criss-cross corresponding ribs of the other plate. After the multiple contact points between crossed ribs are brazed, many flow paths are formed through and around the ribs. It should be noted that wherever the intermediate surfaces 20 and 22 engage one another in a tube pass, the plates are brazed together. These contact points are labeled X in FIG. 3.

Of particular importance in reducing the width of the tube pass without sacrificing heat exchange efficiency, is the particular advantageous formation of ribbed channels in each row. With attention directed to the rightward end of the tube pass in FIG. 1 which shows a portion of lower plate 14, the row includes five full-length ribbed channels 42*a—e*. At either end of the row are formed partial length channels 42*f* and g. These are integrally joined with the offset edge portion 18 of the plate 12. The end ribs or channels 42*f* and g and the next adjacent rib 42 overlap the ends of one another or are staggered, as viewed along the linear flow line between manifolds 24, 26. Therefore, fluid flowing from manifold 24 to manifold 26 passes over at least a portion of ribbed channels 42 before passing around a brazed contact point X, then the flow intersects another ribbed channel in an adjacent row and so on. Thus, the fluid zig-zags through the intermediate fluid flow space formed between portions 22 and 20, rather than flowing straight across. This greatly increases the turbulence and enhances heat exchange efficiency without undesirably increasing the pressure resistance to fluid flow. The efficiency and fluid distribution across the tube width is further encouraged by the formation of the partial-length ribbed channels 42*f* and g which, in conjunction with the intermediate full length channel 42*a–e*, insure flow of fluid immediate the edges 18 of the tube pass, thus forming a very even distribution of flow.

When the heat exchanger core is used as an evaporator in an auto air conditioning system, a housing having an opposite air inlet and outlet encloses the heat exchanger. Air then passes through spaces 16 and over center material 17 and fins 17' therein. Means including resilient seal material supported by the housing (not shown) engage a surface along either end of the evaporator as described hereinafter. Tab projections 44 are formed integrally with plates 12, 14 adjacent manifold configurations 28. The tabs 44 include a portion 46 coplanar with edge 18 and portions 48, 50 normal thereto. Also a parallel portion 52 with portion 46 is provided. The tabs 44 are located at either end of the inlet face of the evaporator as so labeled in FIG. 1. Alignment of tab portions 48 and 50 when the evaporator is assembled and braced together produces a dam or blockage of airflow around the manifold offset portions 28. Without this blockage of airflow, efficiency decreases and under some conditions it has been found that the air outlet temperature may increase by 2° F. The abutment of parallel portions 52 helps secure the pieces and helps fill the gap between tube passes by providing surfaces for braze adhesion.

Figure 6:
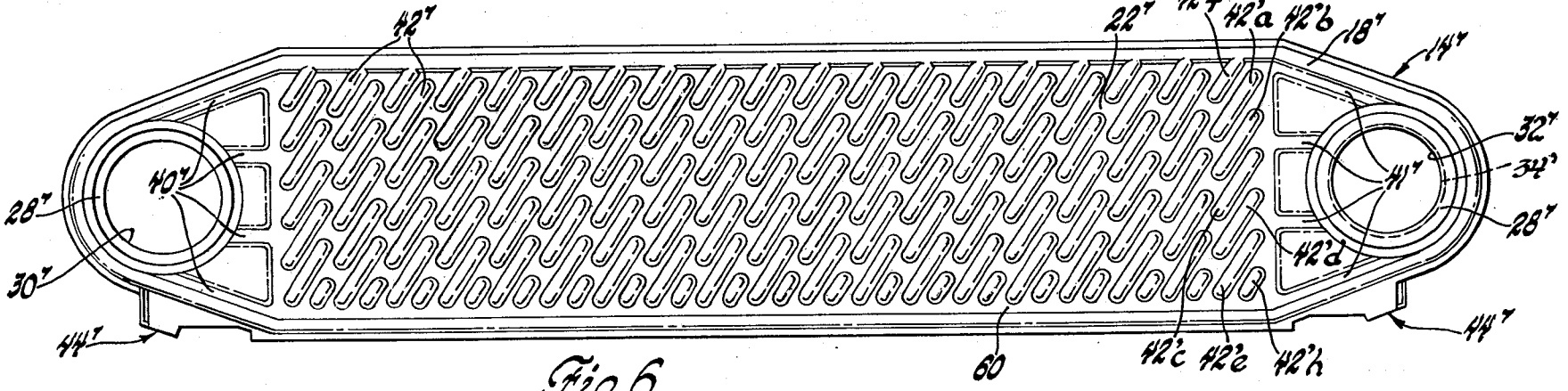
FIG. 6 is a plan view of a second embodiment of a tube pass plate (tube-half) configured according to the invention.
Figure 7:
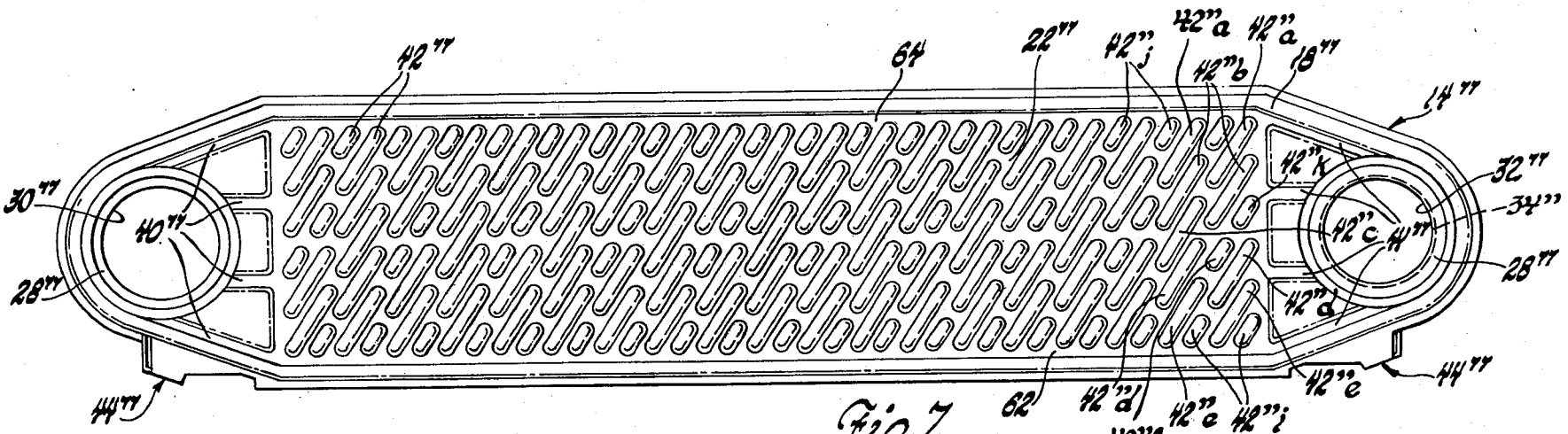
FIG. 7 is a plan view of a third and the most preferred embodiment of a tube pass plate (tube-half) configured according to the invention.

In the above described embodiment of the tube pass plates, enhanced heat transfer performance is obtained without a resultant high pressure drop between the inlet and outlet because of the particular staggered rib arrangement wherein linear flow is prevented around as well as across the rows of ribs. It has also been discovered that enhanced heat transfer performance can be obtained with even less pressure drop between the inlet and outlet by providing a by-pass channel past one end of the rows of staggered ribs as shown in FIG. 6 and also by providing a by-pass channel past both ends of the rows of staggered ribs as well as one less tortuous path across the rows of ribs as shown in FIG. 7. In FIGS. 6 and 7, there is shown only one plate as it will be understood that plates identical to the respective plates shown are to be stacked therewith like in FIGS. 1–5 as previously described in detail to form one or more tube passes. Furthermore, in FIGS. 6 and 7, like reference numbers but single and double primed, respectively, are used to identify structure that is like that in FIGS. 1–5 while substantially different structure is identified by new numbers.

Referring to FIG. 6, there is shown a modified lower plate or tube-half 14' with tab projections 44' that cooperates with an upper plate (not shown) which is identical but inverted and rotated 180° relative thereto for stacking therewith to form a tube pass and air dams. Like in the previous embodiment, the plate has a middle portion 22' which is offset downwardy from the edge portion 18' and with the inlet and outlet manifolds of the tube pass formed by outwardly offset and generally circular portions 28' formed at opposite ends of the plate. An opening 30' is provided in the top surface at one end and an opening 32' is provided with a outwardly raised flange portion 34' at the other end. In addition, there are again provided four flow channels 40' and 41' at each end to permit fluid to pass between the manifolds and the intermediate surface portion 22' of the plate. Furthermore, there is again provided a staggered rib formation including a plurality of relatively short length and spaced ribs 42' which project from the surface area 22'. The ribs are aligned in rows in the tube pass like in the FIG. 1–5 embodiment with the ribs in each row being inclined with respect to the direct flow line between the manifolds. And again, each of these rows includes five full-length ribbed channels 42'a–e and two shorter ones; however, in this case, only the short rib 42'f at one end of each row is integrally joined with the adjacent edge portion 18' of the plate at the corresponding ends of the rows. On the other hand, the short rib 42'h at the opposite end of each of the rows is not joined with the adjacent edge portion 18' so as to instead form a by-pass channel 60 which extends past the corresponding one end of all the rows of the ribs to directly connect the inlet and outlet manifolds the full length of the tube pass. Thus, the channel 60 provides for by-pass flow relative to the tortuous fluid paths formed by the ribs which otherwise remain unchanged from that disclosed in the FIG. 1–5 embodiment. As a result, substantially all the tortuous fluid paths are retained from the FIG. 1–5 embodiment but with the additional single by-pass channel 60 now provided which extends past one end of the rows, there is resultantly less pressure drop because of the limited but direct fluid path between the inlet and outlet.

The plate member or tube-half 14'' shown in FIG. 7 has even less pressure drop between the inlet and outlet as compared with the previous plate member embodiments while maintaining a staggered rib arrangement including ribs 42''a–e providing tortuous fluid paths for enhanced heat transfer performance. In this case, neither of the short length end ribs 42'i and 42''j in each row are joined with the adjacent edge portion 18'' of the plate so that there are formed two pressure drop reducing by-pass channels 62 and 64 which extend past the opposite ends of the rows of ribs the entire length of the tube pass between the inlet and outlet as compared to the single by-pass channel 60 provided in the FIG. 6 tube pass plate member embodiment. Furthermore, the center rib in alternate rows is divided into two partial length ribs 42''k and 42''l so that there is less staggering of the ribs across the middle of the rows and thus a less tortuous path for the fluid to flow across the middle of the rows between the inlet and outlet. It has been discovered that this added feature forces fluid distribution across the transverse rows while providing limited or interrupted linear flow thereacross which acts to maintain the heat transfer gain without losing the decreased pressure drop advantage obtained from the two end by-passes which skirt the transverse rib rows. In the particular arrangement shown, and with there being 19 rows, direct flow across the middle of nine of the rows is prevented by their center rib 42''c whereas in the flow path intermediate these center ribs flow is permitted to pass freely across the other rows between the oppositely facing ends of the partial length center ribs 42''k and 42''l in these rows and the oppositely facing ends of the full length ribs 42''b and 42''d in the rows on opposite sides thereof.

The less interrupted flow path across the middle of the rows provided in the FIG. 7 tube pass plate member embodiment may thus be properly described as an interrupted middle by-pass or interrupted middle linear or longitudinal flow path between the inlet and outlet as compared to the uninterrupted end by-passes or linear or longitudinal flow paths 62 and 64 past or around the ends of the rows. Furthermore, it will be understood that while such interruption has been provided in alternate rows, it will be understood that less interruptions can be provided which would have the effect of further reducing the pressure drop. On the other hand, more interruptions can be provided where more tortuous fluid flow for greater heat transfer performance is desired rather than lowering the pressure drop.

Figure 8:
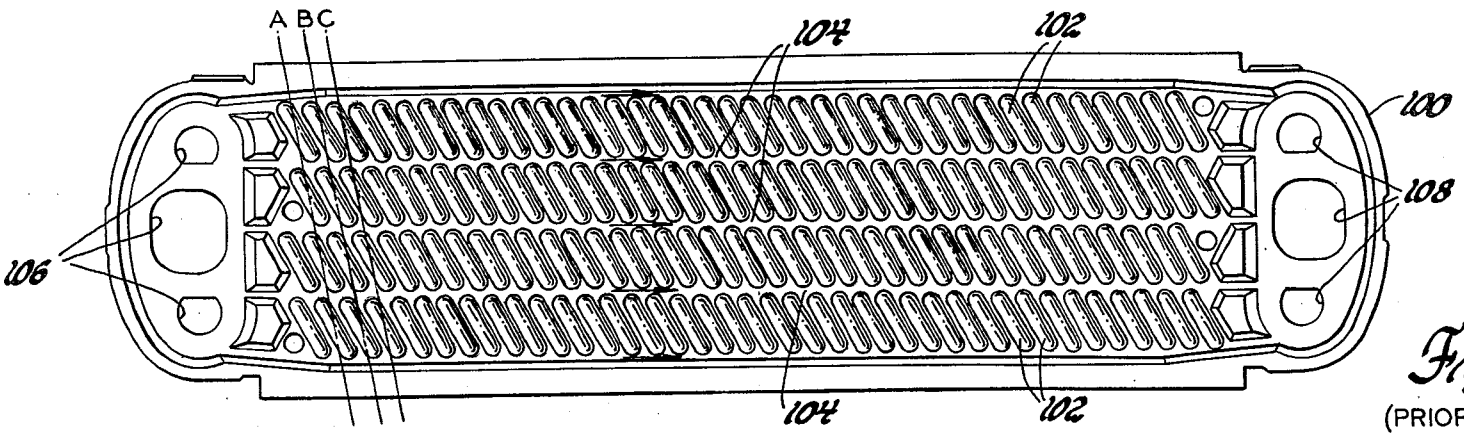
Fig.8 (PRIOR ART)
FIG. 8 is a plan view of a prior art tube pass plate (tube-half)
Figure 9:
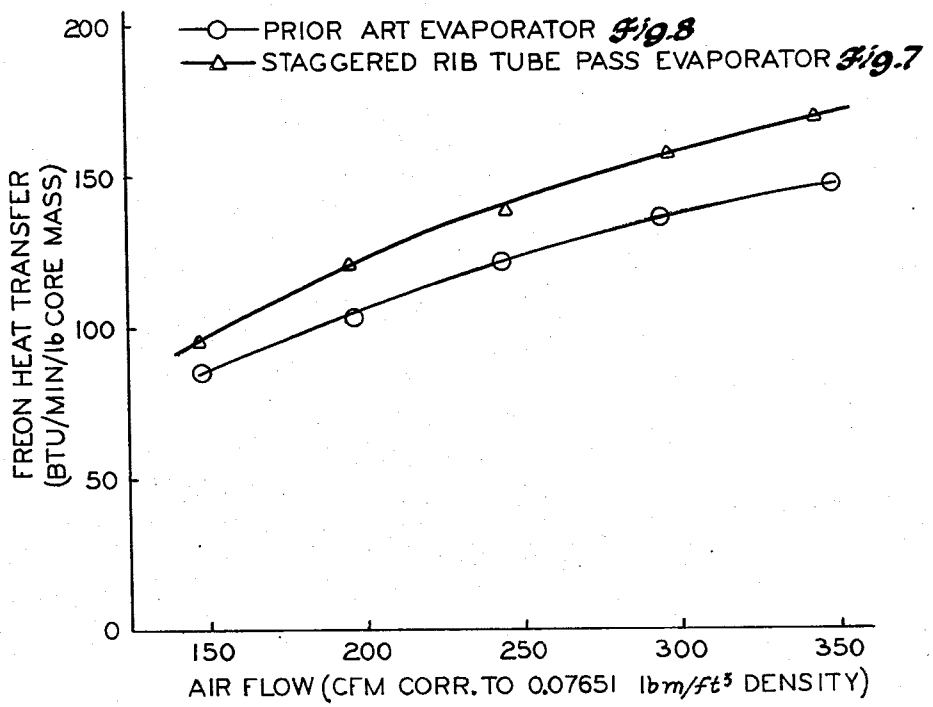
FIG. 9 is a graph comparing the heat transfer characteristics of the FIG. 7 tube pass plate embodiment with those of the FIG. 8 prior art tube pass plate for an equivalent core mass.

The results of tests conducted comparing the most preferred staggered rib tube pass plate embodiment 14'' in FIG. 7 with what is believed to be the most pertinent prior art tube pass plate (see FIG. 8) are reproduced in FIG. 9. This prior art tube pass plate which has been used commercially in evaporator construction for many years by the assignee of this invention and was referred to earlier in the specification is generally designated as 100 in FIG. 8 and has the ribs 102 in each longitudinal row aligned (not staggered) so as to form linear flow paths 104 across the transverse rows A, B, C, etc. between the inlet and outlet openings 106 and 108. The tests were conducted with an automotive air conditioning system in which there was installed a commercial prior art evaporator having a 10-tube pass core formed with the prior art tube pass plates of FIG. 8 and then an evaporator having a 12-tube pass core formed with the staggered rib tube pass plates of FIG. 7 according to the present invention. As can be seen in FIG. 9, the freon heat transfer was desirably substantially higher throughout the air flow range the air conditioning system operates on the vehicle. For example, at the design point of 250 CFM for the particular automotive air conditioning system, there is provided a large 14% improvement (increase) in BTU's per minute per pound core mass.

Thus, it will be appreciated by those skilled in the art that with the above embodiments of tube pass plate members according to the present invention, it is possible to precisely tailor the tube passes for the desired heat transfer performance and allowable pressure drop according to the particular heat exchanger application. Moreover, it is possible because of the improved heat transfer efficiency to accomplish this with a smaller core saving both space and money.

Furthermore, it will be understood that the above described embodiments are illustrative of the invention which may be modified within the scope of the appended claims.

The embodiments of the invention in which an exclusive property or privilege is claimed are defined as follows:

1. In an elongated heat exchanger single tube pass formed by a pair of plates with edge portions joined together and midportions spaced apart to form a fluid enclosure for single pass flow therebetween and wherein opposite ends of the plates have outward offsets from the plane of the midportions to define inlet and outlet manifold enclosures and to form offset surfaces on adjacent tube passes for engagement together when in stacked relation to form air-flow passages between adjacent midportions of the tube passes, the improvement comprising: a plurality of transverse rows of separated ribs formed in the midportion of each plate and extending transversely substantially the width thereof and with the ribs in each transverse row angled obliquely to the length and width thereof, the ribs in each transverse row being unconnected with each other and overlapping and staggered with respect to the ribs in the same row and to ribs in the adjacent row and spaced from the edge portions of the plate so as to prevent a direct linear flow path across all the transverse rows while forming uninterrupted by-pass flow paths past the ends thereof between the inlet and outlet enclosures, at least some of the ribs in at least some adjacent rows including aligned ribs providing a linear flow path across these rows which is interrupted by ribs in other rows so as to form an interrupted linear flow path across the transverse rows between the inlet and outlet enclosures, and the angled ribs of one plate extending across the corresponding and adjacent angled ribs of the other plate of the tube pass to form multiple contacts and thus provide a tortuous flow path over and around the ribbed surfaces and contact points therebetween wherein the interrupted linear flow path between the inlet and outlet enclosures forces fluid distribution across the transverse rows while providing interrupted linear flow thereacross to improve the heat transfer efficiency of the tube pass while cooperating with the by-pass flow paths to minimize the pressure drop therein.

2. In an elongated heat exchanger single tube pass formed by a pair of plates with edge portions joined together and midportions spaced apart to form a fluid enclosure for single pass flow therebetween and wherein opposite ends of the plates have outward offsets from the plane of the midportions to define inlet and outlet manifold enclosures and to form offset surfaces on adjacent tube passes for engagement together when in stacked relation to form airflow passages between adjacent midportions of the tube passes, the improvement comprising: a plurality of transverse rows of separated ribs formed in the midportion of each plate and extending transversely substantially the width thereof and with the ribs in each transverse row angled obliquely to the length and width thereof, the ribs in each transverse row being unconnected with each other and overlapping and staggered with respect to the ribs in the same row and to ribs in the adjacent row and spaced from the edge portions of the plate so as to prevent a direct linear flow path across all the transverse rows while forming uninterrupted by-pass flow paths past the ends thereof between the inlet and outlet enclosures, alternate ones of the transverse rows having two centrally located partial length ribs which form a linear flow path therebetween through these rows that is interrupted by the ribs in the other rows to thereby form an interrupted linear flow path centrally across the transverse rows between the inlet and outlet enclosures, and the angled ribs of one plate extending across the corresponding and adjacent angled ribs of the other plate of the tube pass to form multiple contacts and thus provide a tortuous flow path over and around the ribbed surfaces and contact points therebetween wherein the centrally located interrupted linear flow path between the inlet and outlet enclosures forces fluid distribution across the transverse rows while providing interrupted linear flow thereacross to improve the heat transfer efficiency of the tube pass while cooperating with the by-pass flow paths to minimize the pressure drop therein.

* * * * *